US006181244B1

(12) United States Patent
Hall et al.

(10) Patent No.: US 6,181,244 B1
(45) Date of Patent: Jan. 30, 2001

(54) CONSTRUCTION SITE PORTABLE MONITORING SYSTEM

(75) Inventors: Jackson Lee Hall, Eden Prairie; William Wood, Apple Valley; Timothy Loftus, Minneapolis, all of MN (US)

(73) Assignee: General Security Services Corporation, Minneapolis, MN (US)

( * ) Notice: Under 35 U.S.C. 154(b), the term of this patent shall be extended for 0 days.

(21) Appl. No.: 09/183,260

(22) Filed: Oct. 30, 1998

(51) Int. Cl.[7] ..... G08B 13/00

(52) U.S. Cl. ..... 340/541; 340/539; 340/691.1; 340/693.5; 340/693.12

(58) Field of Search ..... 340/541, 540, 340/539, 691.1, 691.4, 693.15, 693.12, 506, 521, 571, 568.1, 577, 584, 586, 628, 632

(56) References Cited

U.S. PATENT DOCUMENTS 3,206,744 * 9/1965 Nelson ..... 340/908
4,201,975 * 5/1980 Marcus ..... 340/908
5,200,735 * 4/1993 Hines ..... 340/539
5,463,595 * 10/1995 Rodhall et al. ..... 340/573.1
5,907,294 * 5/1999 Welte et al. ..... 340/903

* cited by examiner

*Primary Examiner*—Nina Tong
(74) *Attorney, Agent, or Firm*—Merchant & Gould P.C.

(57) ABSTRACT

A portable monitoring system for use at sites, such as construction sites, is provided. The portable monitoring system can provide enhanced security at such sites and may be quickly set up and taken down. A portable monitoring system, in accordance with one embodiment of the invention, includes a housing and a plurality of portable sensing devices and a plurality of mounting platforms both capable of being removably stored in the housing. The mounting platforms may be easily retrieved from the housing and disposed about the site and are each capable of detachably mounting one or more of the portable sensing devices. The portable sensing devices each include a sensor for sensing a stimulus and a transmitter, coupled to the sensor, for transmitting a signal associated with the stimulus. The housing further includes a communication system for receiving the transmitted signals from each of the portable sensing devices and communicating signals associated with the sensed stimuli to an external system.

18 Claims, 4 Drawing Sheets

CONSTRUCTION SITE PORTABLE MONITORING SYSTEM

FIELD OF THE INVENTION

The present invention generally relates to the portable monitoring systems and, more particularly, to portable monitoring systems for use at construction sites.

BACKGROUND OF THE INVENTION

Construction sites, especially large scale construction sites for office buildings, are increasingly undergoing vandalism. The vandalism extends to property damage as well as the destruction of construction equipment and building materials. In response, property owners and construction companies have attempted to limit access to and/or monitor construction sites. Limiting access is, however, difficult and, in early stages of construction, nearly impossible. Property owners and construction companies have also used monitoring systems to deter vandalism. These attempts have also been in vain. For example, such monitoring systems typically emit an audible alarm upon sensing a particular event, such as motion, and, especially in remote areas, are seldom heard.

SUMMARY OF THE INVENTION

The present invention provides portable monitoring systems for use at sites, such as construction sites. The portable monitoring systems can provide enhanced security at such sites and may be quickly set up and taken down. A portable monitoring system, in accordance with one embodiment of the invention, includes a housing and a plurality of portable sensing devices and a plurality of mounting platforms both capable of being removably stored in the housing. The mounting platforms may be easily retrieved from the housing and disposed about the site and are each capable of detachably mounting one or more of the portable sensing devices. The portable sensing devices each include a sensor for sensing a stimulus and a transmitter, coupled to the sensor, for transmitting a signal associated with the stimulus. The housing further includes a communication system for receiving the transmitted signals from each of the portable sensing devices and communicating signals associated with the sensed stimuli to an external system.

The above summary of the present invention is not intended to describe each illustrated embodiment or every implementation of the present invention. The figures and the detailed description which follow more particularly exemplify these embodiments.

DETAILED DESCRIPTION OF THE DRAWINGS

The invention may be more completely understood in consideration of the following detailed description of various embodiments of the invention in connection with the accompanying drawings, in which.

Figure 2:
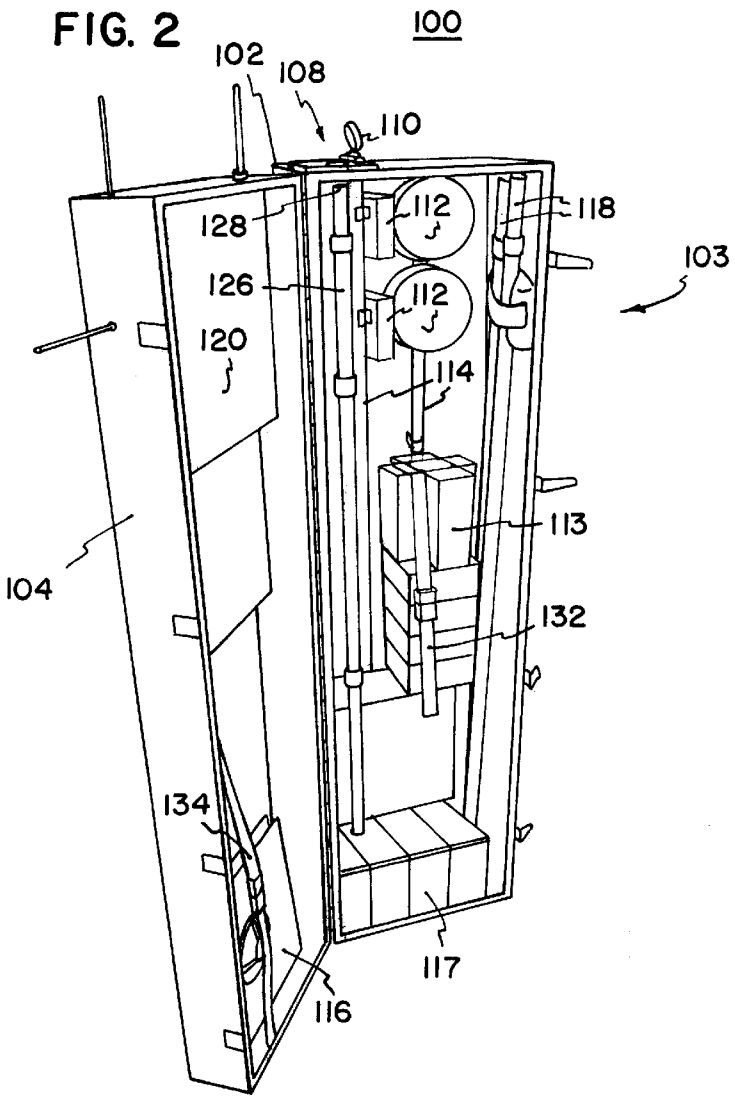
FIG. 2 is a perspective view of the exemplary portable monitoring system shown with its door open in accordance with one embodiment of the invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION

The present invention generally relates to portable monitoring systems for sites, such as construction sites. The portable monitoring systems generally enhance security at a site. The portable monitoring systems also have one or more ergonomic features which facilitate the use (e.g., storage and set-up) of the system at a site. An appreciation of the various aspects of the invention will be gained through a discussion of the exemplary embodiments discussed below.

Figure 1:
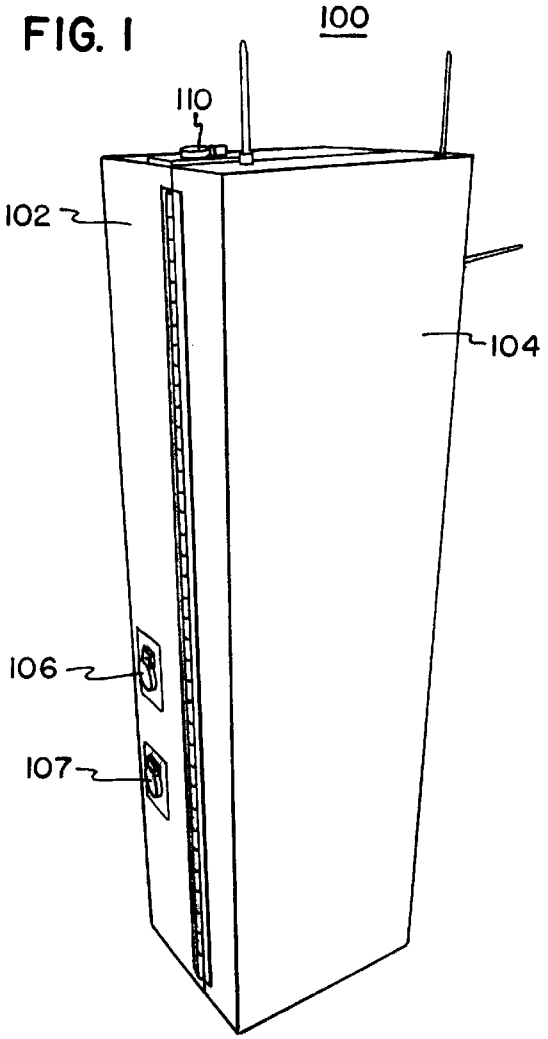
FIG. 1 is a perspective view of an exemplary portable monitoring system shown with its door closed in accordance with one embodiment of the invention.

FIG. 1 illustrates a perspective view of an exemplary portable monitoring system in accordance with one embodiment of the invention. The exemplary monitoring system 100 generally includes a housing 102 having a door 104, shown closed in FIG. 1. As will be discussed below, the housing 102 stores a number of different components of the portable monitoring system 100. The housing 102 is adequately sized to hold these components. Suitable dimensions for the exemplary housing 102 include a width ranging from about 15 to 20 inches, a depth ranging from about 15 to 20 inches, and height ranging from about 36 to 48 inches. These dimensions are provided by way of example only. Larger or smaller housings may be provided depending on the size and number of components to be held within the housing. The construction material of the housing 102 can vary and typically is formed from a relatively sturdy and tamper-proof material, such as metal. The door 104 may further include a handle and a lock (not shown) for securing the components within the housing 102, for example, during transport and after set up.

The housing 102 may further include one or more telephone jacks 106 for coupling the system 100 to an external telephone system. An outlet 107 may also be provided on the housing 102 for coupling the system 100 to a power source. The housing 102 may also include an aperture 108, typically covered by a pivotable or otherwise movable cover 110 as best shown in FIGS. 1 and 2. The aperture 108, as will be discussed further below, allows for efficient setup of a dedicated mounting platform for a sensing device. While not shown, the housing 102 typically includes one or more handles for facilitating the portability of the system 100.

FIG. 2 illustrates a perspective view of the system 100 with its door 104 open and an exemplary layout of system components within the housing 102 during storage, for example. It is noted that a number of the components are dedicated components that remain within and/or physically attached to the housing 102 during storage as well as during use. Other components are removably stored within the housing 102 so that they may be readily disposed about a site for monitoring.

As shown in FIG. 2, the system 100 generally includes a plurality of portable sensing devices 112 and 113 and multiple bases 116 and poles 118, all of which may be removably stored within the housing 102. Each portable sensing device 112 generally includes a sensor for sensing a stimulus and transmitter, coupled to the sensor, for transmitting a signal associated with a stimulus, such as heat, motion, etc. The portable sensing devices 112, with the exception of their attaching devices as discussed below, may be conventional sensing devices. While not exhaustive, exemplary sensing devices include motion sensors, smoke detectors, humidity sensors, temperature sensors, heater flameout sensors (along with any associated cable). One or more storage poles 114, typically dedicated storage poles, may be provided within the housing 102 for removably receiving the portable sensing devices 112 for storage. The bases 116 and poles 118 may be attached together to form pole/base arrangements which may be disposed about a site. The pole/base arrangements generally provide mounting platforms on which one or more of the portable sensing devices 112 may be detachably mounted. The pole/base arrangements are provided by way of example, not of limitation. Other types of mounting platforms which may be removably stored within the housing and which are capable of detachably mounting one or more portable sensing devices may be used.

The housing 102 further includes retention means, such as straps 132 and 134, for retaining the poles 118 and bases 116 within the housing 102. The straps 132 and 134 may, for example, be stretchable cords, straps with hook and loop fasteners, or straps with buckle fasteners, for example. The bases 116 may be held in the housing 102 beneath a communication system 120 using the strap 134, while the poles 116 may be held within the main body 103 of the housing 102, typically along one of the walls of housing 102 using the strap 132. This allows for easy access to both the bases 116 as well as the poles 118 and further facilitates setup and storage of the system 100.

Figure 6:
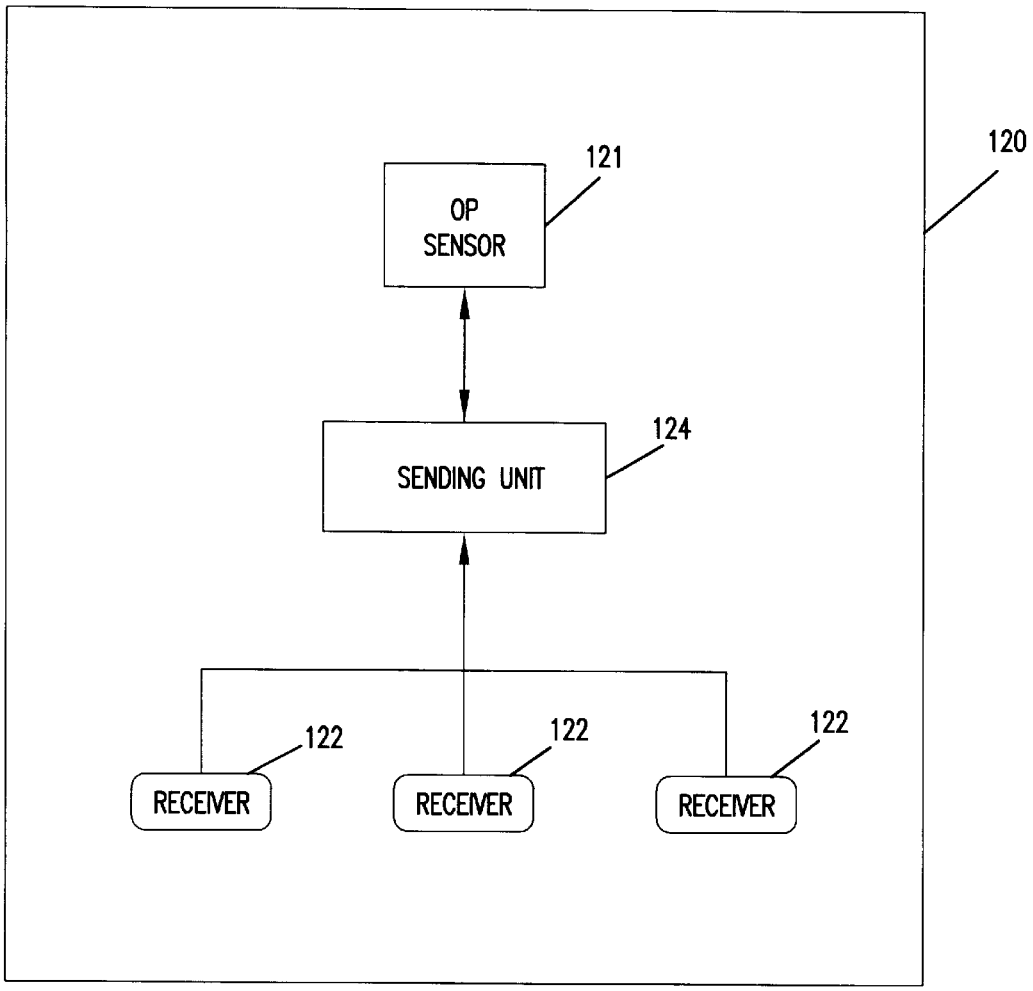
FIG. 6 illustrates an exemplary communication system in accordance with another embodiment of the invention.

The system 100 further includes a communication system 120, mounted within the housing 102, for receiving the transmitted signals from each of the portable sensing devices and sending signals to an external system based on the received signals. As illustrated in FIG. 6, the communication system 120 may, for example, include a plurality of receiving units 122, each of which may be assigned to a particular one of the portable sensing devices 112 for receiving the signal transmitted thereby. The communication system 120 may further include a sending unit 124 coupled to the receiving units 122 for sending signals to an external system when the receiving units 122 receive transmitted signals from the portable sensing devices 112. The communication between the portable sensing devices 112, the communication system 120, and the external system may be continuous, periodic, or only when a sensed stimulus exceeds a predetermined threshold, depending on the monitoring level desired at the site.

The sending unit 124 typically includes a telephone unit coupled to the telephone jack 106 for communication with the external system. The sending unit 124 may further include a cellular phone unit capable of wireless communication with the external system. The communication system 120 may further include an operational sensor 121 capable of sensing the operational status of the telephone unit and switching to the cellular unit when the telephone unit is not operating (e.g., no outside line available). In this manner, the communication system 120 can signal a downed telephone unit or outside line. The operational sensor 121 allows the use of a cellular phone for times when the telephone system is down but does not require reliance on the cellular phone at all times. The communication between the portable sensing devices 112 and the communication system 120 is typically wireless. This allows for rapid installation and high ease of use of the system 100. However, hard wiring may be used if desired.

Turning back to FIGS. 1 and 2, the system 100, as noted above, typically includes an outlet 107 for coupling the system 100 to a power source. The system 100 may further include a battery or battery package 117 which the system 100 may switch to in the event of a power failure. Alternatively, the system 100 may use a battery as its sole power supply. As should be appreciated, the communication system 120 is coupled to a power supply (e.g., battery package 117 or via outlet 107).

The housing 102 may further include an extendible pole 126 for locally mounting portable sensing devices 112 and 113 on the housing 102. The pole 126 is typically a dedicated pole which is aligned with the aperture 108. The pole 126 is generally extendible through the aperture 108 for mounting one or more portable sensing devices 112 and 113 and retractable for storage within the housing 102. A portable sensing device 112 may be mounted to the pole 126 using snaps, which will be discussed below. In the exemplary embodiment, the pole 126 includes an electrical receptacle 128, typically a threaded receptacle, for detachably mounting and electrically coupling a particular portable sensing device 113. The electrical receptacle is typically hard-wired to the system 100 power supply (e.g., outlet 107 and/or battery package 117) via the pole 126. The pole 126/aperture 108 arrangement provides an easy means of mounting a portable sensing device on the housing 102. The hard wiring further facilitates the use of a relatively high powered portable sensing device 113.

Figure 3:
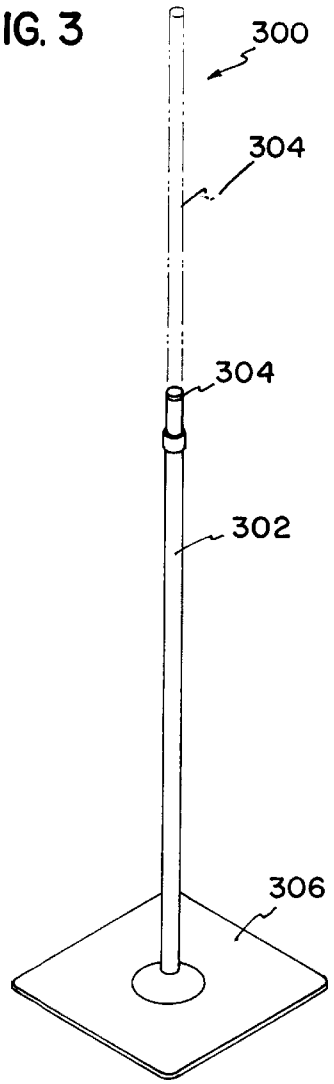
FIG. 3 illustrates an exemplary mounting platform in accordance with another embodiment of the invention.

Turning now to FIG. 3, there is illustrated an exemplary pole 300 for mounting one or more portable sensing devices 112. The pole 300 generally includes a base portion 302 which may be retracted within the base portion 302 for storage in housing 102 and an extendible portion 304 which may be extended from the base portion 302 for disposal about the site. In use, the pole 300 is typically mounted to a base 306 by screwing the base pole portion 302 into a threaded receptacle of the base 306. The pole 302 may then be extended to an extended position by extending the extendible portion 304 out of the base portion 302. While the invention is not limited to poles or even extendible poles, extendible mounting platforms such as extendible poles, improves the range of the portable sensing devices and enhance the monitoring of the site.

Figure 4:
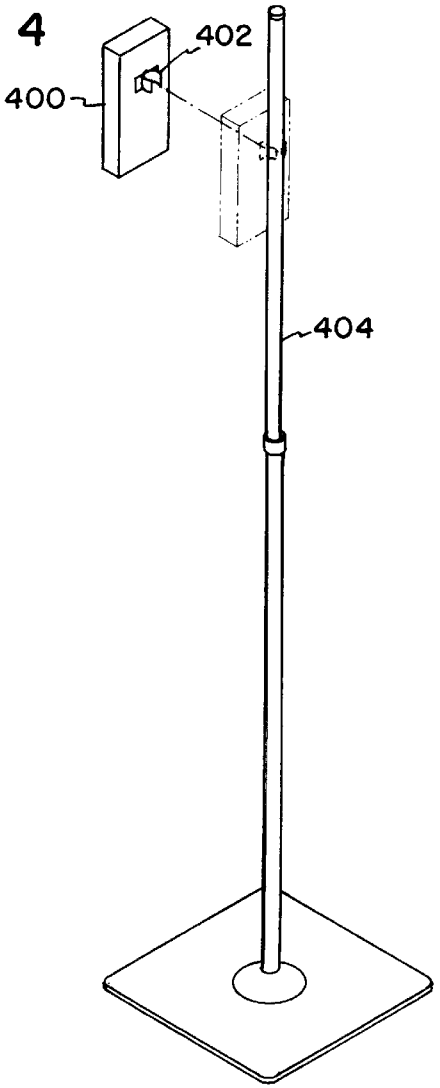
FIG. 4 illustrates an exemplary sensing device in accordance with another embodiment of the invention.

FIG. 4 illustrates an exemplary portable sensing device in conjunction with a pole/base arrangement. The portable sensing device 400 generally includes an attachment device, such as a U-shaped bracket 402, which allows the portable sensing device 400 to be removably mounted, e.g., snapped, on an extension pole 404. The bracket 402 also allows the portable sensing device 400 to be removably mounted on the pole 126 within the housing 102. In this manner, the bracket 402 allows the portable sensing device 400 to be rapidly stored in the housing as well as removed from the housing and mounted on a mounting platform. The bracket 402, while advantageous, is provided by way of example and not of limitation. Other removable attaching means may be used to attach the portable sensing devices to mounting platforms within the scope of the invention.

Figure 5:
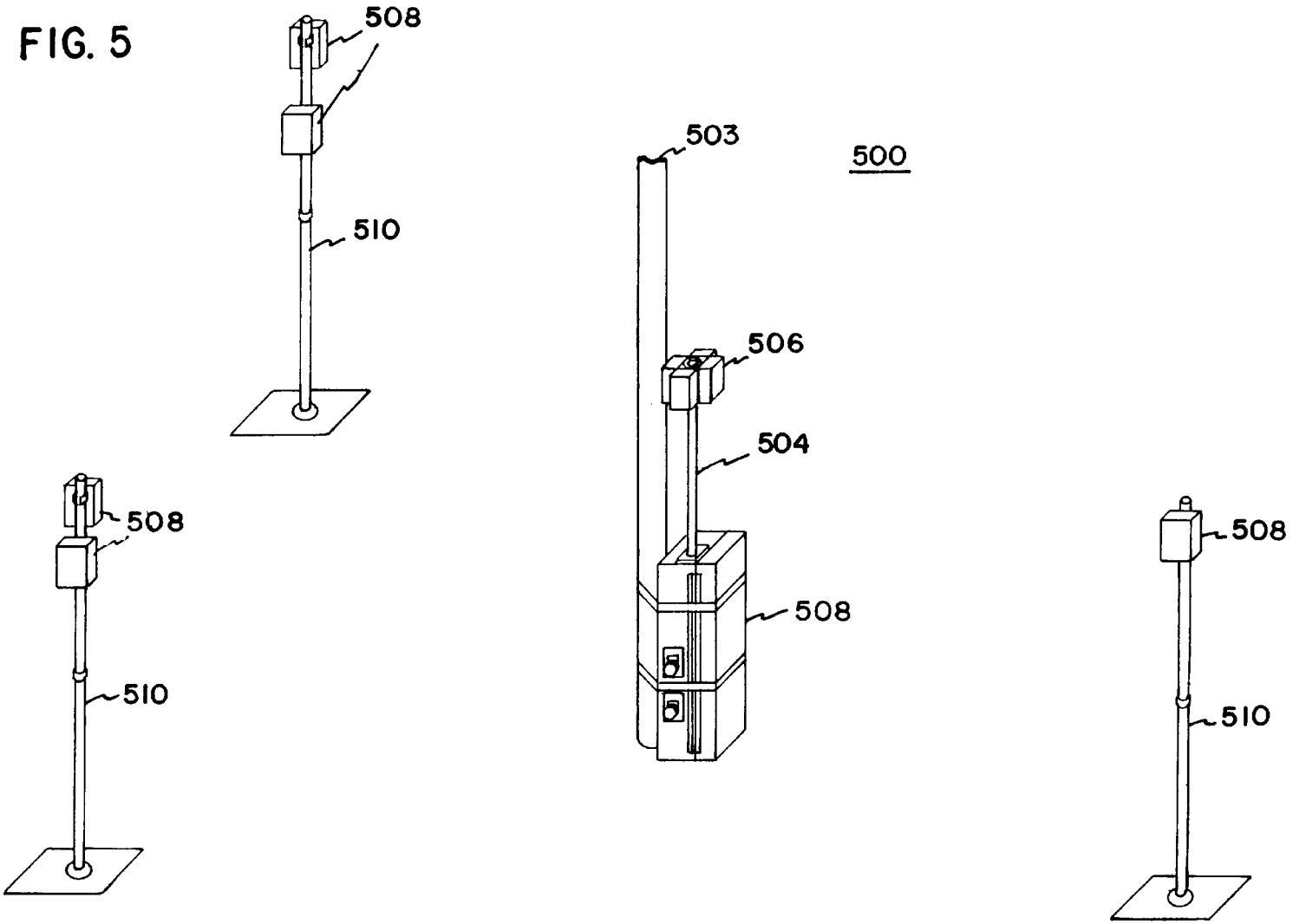
FIG. 5 illustrates an exemplary portable monitoring system set up at a site in accordance with another embodiment of the invention.

FIG. 5 illustrates and exemplary portable monitoring system 500 setup at a site, such as a construction site. The portable monitoring system 500 includes a housing 502 having an extension pole 504 extending outwardly therefrom. Mounted on the end of the extension pole 504 is a first portable sensing device 506, typically a power-intensive device such as a group of motion sensors. The housing 502 stores a communication system for communicating with portable sensing devices as discussed above. The housing 502 may be placed in any desired location within a site. Generally, the housing 502 is securely attached to a permanent structure 503, such as a column or beam, within the site. The housing 502 may, for example, be attached using relatively strong cables and may be provided with a sensing unit which senses if the cables are cut or tampered with and, in response, sends a signal to the communication system for monitoring the security of the housing 502 itself. Also shown in FIG. 5 are a plurality of portable sensing devices 508 mounted on pole/base arrangements 510 disposed about the site. The pole/base arrangements 508 are typically used in their extended position to increase the range of the portable sensing devices 510 mounted thereon.

As noted above, the present invention provides portable monitoring systems for use at a number of different locations, including construction sites. The present invention should not be considered limited to the particular examples described above, but rather should be understood to cover all aspects of the invention as fairly set out in the attached claims. Various modifications, equivalents and alternatives to which the present invention may be applicable will be readily apparent to those of skill in the art to which the present invention is directed upon review of the present specification. The claims are intended to cover such modifications, equivalents and alternatives.

What is claimed is:

1. A construction site portable monitoring system for use at a construction site, comprising:

a housing;

a plurality of portable sensing devices capable of being stored in the housing, each portable sensing device including a sensor for sensing a stimulus and a transmitter, coupled to the sensor, for transmitting a signal associated with the stimulus; and a plurality of mounting platforms capable of being removably stored in the housing and disposed about the construction site, each mounting platform being capable of detachably mounting one or more of the portable sensing devices;

wherein the housing includes a communications system for receiving the transmitted signals from each of the portable sensing devices and communicating signals to an external system based on the received signals.

2. The portable security system of claim 1, wherein the plurality of mounting platforms includes a plurality of bases and a plurality of poles capable of being removably mounted to the bases.

3. The portable security system of claim 2, wherein the poles are extendible between a retracted position for storage in the housing and an extended position for disposal about the construction site.

4. The portable security system of claim 3, wherein the housing includes pole retention means for retaining the poles within an area of the housing and base retention means for retaining the bases in another area of the housing.

5. The portable security system of claim 4, wherein the housing includes a main body and a door, the pole retention means being mounted in the main body and the base retaining means being mounted in the door.

6. The portable security system of claim 2, wherein each of the sensing devices includes a unshaped bracket for detachably mounting on the poles.

7. The portable security system of claim 6, wherein the housing further includes a pole for detachably mounting the sensing devices by the brackets for holding the sensing devices within the housing when not in use.

8. The portable security system of claim 2, wherein the housing further includes an aperture in an exterior wall and an extendible pole within the housing and aligned with the aperture, the extendible pole being extendible between an extended position extending outside of the housing and a retracted position housed within the housing.

9. The portable security system of claim 8, wherein the extendible pole includes a electrical receptacle for detachably mounting and electrically coupling one of the portable sensing devices.

10. The portable security system of claim 1, wherein the communications system includes a telephone unit for communicating signals to the external system via a telephone line.

11. The portable security system of claim 10, wherein the communications system further includes a cellular unit capable of wirelessly communicating with the external system.

12. The portable security system of claim 11, wherein the housing further includes an operational sensor capable of sensing the operational status of the telephone unit and switching to the cellular unit when the telephone unit cannot communicate with the external system.

13. The portable security system of claim 1, wherein the signal sent by each transmitter is a wireless signal.

14. The portable security system of claim 1, wherein the plurality of portable sensing devices includes at least one of a motion sensor, smoke sensor, humidity sensor, heater flameout sensor or temperature sensor.

15. A portable monitoring system, comprising:

a housing;

a plurality of portable sensing devices capable of being removably stored in the housing, each portable sensing device including a sensor for sensing a stimulus and a transmitter, coupled to the sensor, for transmitting a wireless signal indicative of the status of the stimulus; and a plurality of extension poles and pole mounting platforms capable of being removably stored in the housing and disposed about the construction site, each pole being capable of detachably mounting one or more of the portable sensing devices and being detachably mountable on a base;

wherein the housing includes a communications system for receiving the transmitted signals from each of the portable sensing devices, communicating a signal based on the transmitted signals to an external system.

16. The portable security system of claim 15, wherein the poles are extendible between a retracted position for storage in the housing and an extended position for disposal about the construction site.

17. The portable security system of claim 16, wherein the housing further includes an aperture in an exterior wall and an extendible pole within the housing and aligned with the aperture, the extendible pole being extendible between an extended position extending outside of the housing and a retracted position housed within the housing.

18. The portable security system of claim 17, wherein the housing further includes an operational sensor capable of sensing the operational status of a telephone unit and switching to a cellular unit when the telephone unit is not operating.

* * * * *